US005232090A

United States Patent [19]

Raab et al.

[11] Patent Number: 5,232,090

[45] Date of Patent: Aug. 3, 1993

[54] FAN HAVING STABILIZING FEET

[75] Inventors: John J. Raab, Brielle; Victor Pajak, Wayne; Joseph Yuan, Edgewater, all of N.J.

[73] Assignee: Robeson Industries Corp., Plainfield, N.J.

[21] Appl. No.: 850,922

[22] Filed: Mar. 13, 1992

[51] Int. Cl.[5] ..... B65D 85/00; F04D 29/60

[52] U.S. Cl. ..... 206/320; 416/244 R

[58] Field of Search ..... 416/244 R, 246, 247; 417/234, 423.14, 423.15, 423.7; 248/167, 188.8, 677; 415/121.2, 213.1; 206/320, 576

[56] References Cited

U.S. PATENT DOCUMENTS

| | | | |
|---|---|---|---|
| 2,011,791 | 8/1935 | Barrett | 416/244 R |
| 3,500,738 | 3/1970 | Wenig | 415/121.2 |
| 4,341,151 | 7/1982 | Sakamoto | 416/247 R |
| 4,350,472 | 9/1982 | Morimoto | 415/121.2 |
| 5,110,263 | 5/1992 | Chiu | 416/244 R |

FOREIGN PATENT DOCUMENTS

| | | | |
|---|---|---|---|
| 20693 | 1/1987 | Japan | 416/244 R |

*Primary Examiner*—Edward K. Look

*Assistant Examiner*—James A. Larson

*Attorney, Agent, or Firm*—Fiddler Levine & Mandelbaum

[57] ABSTRACT

A fan having a rectangular frame including a bottom wall, two side walls, and a top wall, and a motor-driven impeller supported within the frame for causing air to move through the frame in an axial direction. The frame has at least one, and preferably two, stabilizing feet moveable between an extended position, in which each foot projects axially beyond the contour of the fan frame, and a retracted position, in which the foot does not project axially beyond the contour of the fan frame. Resilient elements, such as springs, constantly urge the stabilizing feet toward their extended positions. The stabilizing feet may be pivotally mounted on the fan frame, and stops are provided against which each foot abuts when the foot is in its extended position. A packing box snugly accommodates the fan during storage and shipment of the fan, and the stabilizing feet engage the interior surface of the box so that the box retains the feet in their retracted positions against the force of the resilient members, the resilient members serving to automatically spring the feet into their extended positions upon removal of the fan from the box.

10 Claims, 2 Drawing Sheets

FIG. 1
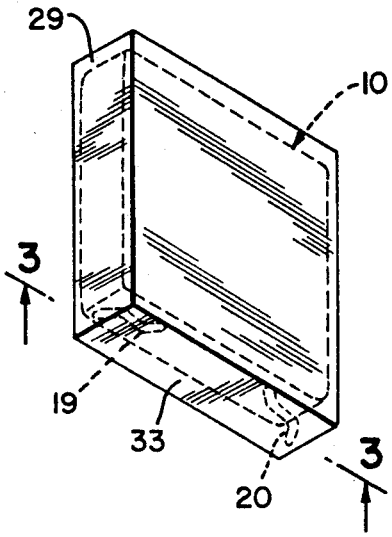
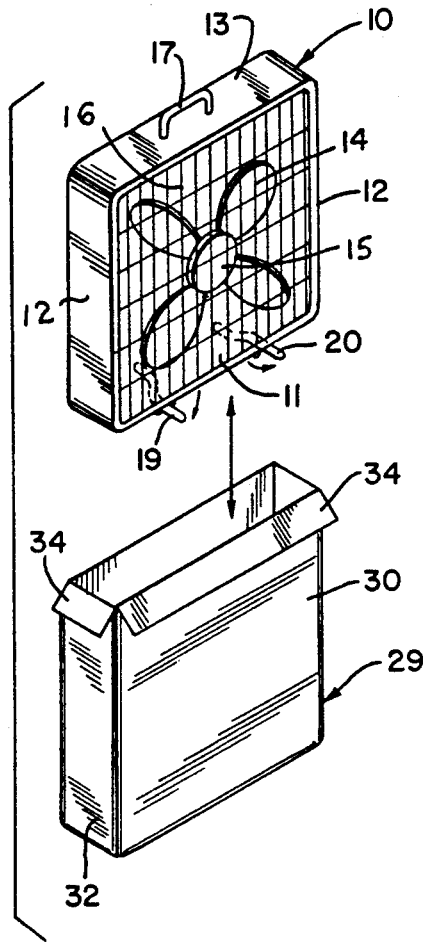
FIG. 2
FIG. 5
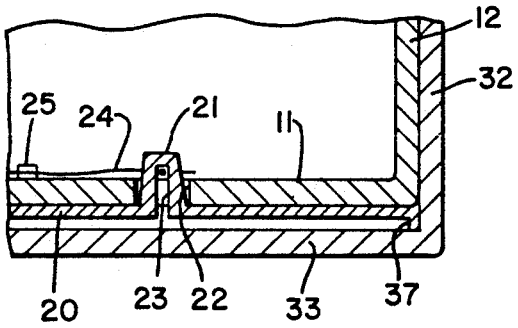
FIG. 6
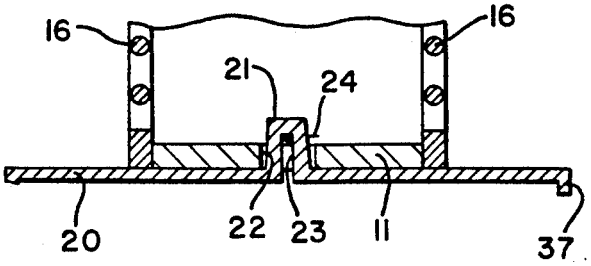

FAN HAVING STABILIZING FEET

This invention relates to fans of the type designed for household use, which provide air circulation in a room during hot weather.

Such fans typically include a rectangular, usually square, frame supporting within it a fan impeller and an electric motor for driving the impeller. When the motor is energized and the impeller rotated, air is moved in an axial direction through the frame, the air being drawn into one end face of the frame and expelled through the opposite end face. For the sake of safety, each end face is covered by a grill.

As the fan impeller rotates pushing air through the fan frame, the impeller, and hence the fan frame, experience a reaction force tending to push the fan in the direction opposite to the direction of air flow. If the fan is not stabilized, this reaction force can tip the fan over so that the end face of the frame through which air enters comes to rest upon the floor, or other surface upon which the fan was supported. With the inlet face of the fan blocked in this way, the fan motor can overheat and burn out, or before the motor burns out a protective fuse in the fan will blow. In either case, the fan is now out-of-service and requires repair.

To avoid this problem, it is common practice to provide fans of this type with stabilizing feet. These feet are essentially strips of rigid material packed in the box with the fan. When the consumer removes the fan from the box, he or she is supposed to also remove the stabilizing feet and attach them to the bottom wall of the fan frame. The feet extend in an axial direction beyond the contour of the bottom wall of the frame so as to stabilize the fan against tipping due to the reaction force of air flowing through the fan.

However, in practice, many consumers fail to follow instructions and do not attach the stabilizing feet to the fan. As a result, the fan is subject to tipping over, as described above, leading to the problem of motor burn out or blowing of the protective fuse.

This problem could be overcome by permanently mounting stabilizing feet on the fan frame, such feet extending axially beyond the contour of the frame. However, such a solution is undesirable since a fan with permanently attached feet would require a much larger shipping container than is needed to accommodate the fan without attached stabilizing feet. A larger packing box occupies more storage and shipping space, and hence is undesirable.

It is an object of the present invention to overcome these problems by providing a fan of the type described including feet which passively stabilize the fan, i.e., which assume their supporting positions without requiring any adjustment of the feet by the fan user.

It is another object of the invention to provide such a fan which requires a packing box no larger than that required by a fan furnished with unattached stabilizing feet.

It is a further object of the invention to provide such a fan having stabilizing feet which, when the fan is in its packing box, assume a retracted position in which the feet do not extend axially beyond the contour of the fan frame, but which automatically spring into an extended position, in which the feet extend axially beyond the contour of the fan frame, when the fan is removed from its packing box.

Additional objects and features of the invention will be apparent from the following description, in which reference is made to the accompanying drawings.

In the drawings:

FIG. 1 is a perspective view, from the bottom, of a fan accommodated within a packing box;

FIG. 2 is an exploded perspective view showing the fan removed from the packing box;

FIG. 5 is fragmentary cross-sectional view taken along line 5—5 of FIG. 3; and

FIG. 6 is a fragmentary cross-sectional view taken along line 6—6 of FIG. 4.

Figure 3:
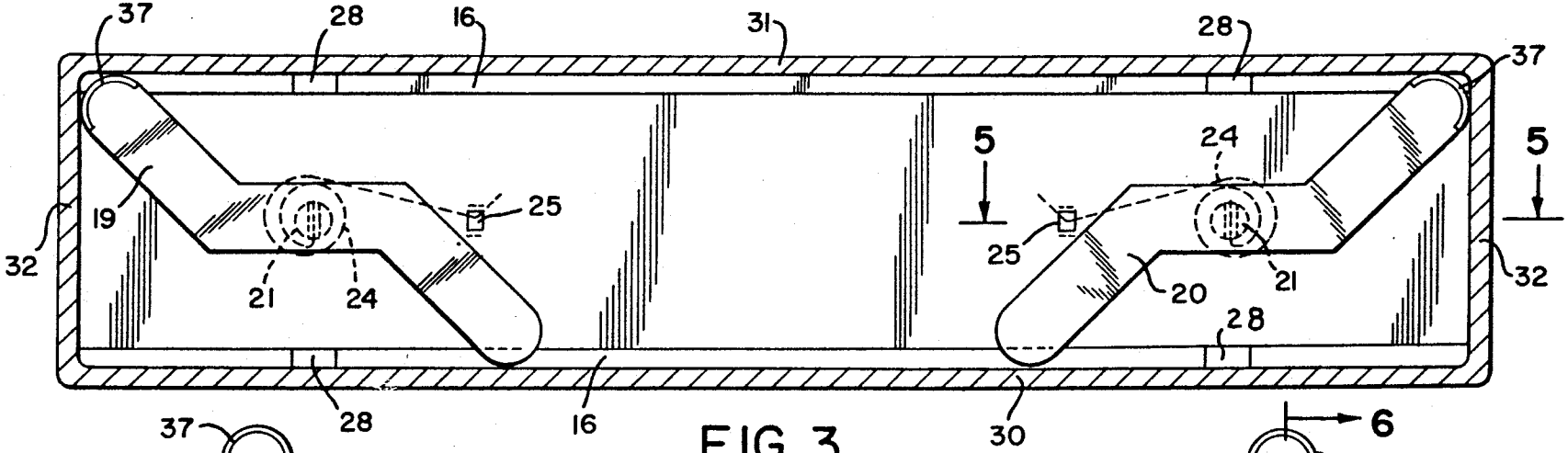
FIG. 3 is bottom view of the fan within the packing box, taken along line 3—3 of FIG. 1, with the bottom of the box removed to help clearly illustrate the invention.

The fan 10 (FIG. 2) chosen to illustrate the present invention has a square frame defined by a bottom wall 11, two side walls 12, and top wall 13. Supported within the frame is fan impeller 14 and an electric motor 15 for rotating the impeller. Mounted over each open end face of the fan frame is a safety grill 16, and top wall is provided with a carrying handle 17. As thus far described, the fan is completely conventional.

According to the present invention, at least one and preferably two, stabilizing feet 20 are pivotally secured to bottom wall 11 of the fan frame, the feet being adjacent to the outer surface of wall 11. In the present example, each stabilizing foot is a generally S-shaped, flat rigid element. At about its midpoint, each foot 20 presents an upstanding pivot pin 21 which projects upwardly through a hole 22 in bottom wall 11 of the fan frame (FIGS. 5 and 6). Pin 21 is formed with a slot 23 accommodating one end of a spiral spring 24, the body of the spring surrounding pin 21. The other end of spring 24 extends from pivot pin 21, and is captured by a tab 25 which may be struck out of the material of bottom wall 11 and projects upwardly from that wall. The arrangement is such that springs 24 constantly urge foot 19 in a clockwise direction and foot 20 in a counterclockwise direction, when the fan is viewed from the bottom, as in FIGS. 3 and 4.

The stabilizing feet 19 and 20 are so sized, and the holes 22 in bottom wall 11 are so located, that the feet 19 and 20 can be pivoted to a retracted position, shown in FIGS. 3 and 5, in which they are located completely within the contour of bottom wall 11, i.e., the feet do not extend in the axial direction (arrow 26 in FIG. 4) of the fan beyond the contour of bottom wall 11.

Figure 4:
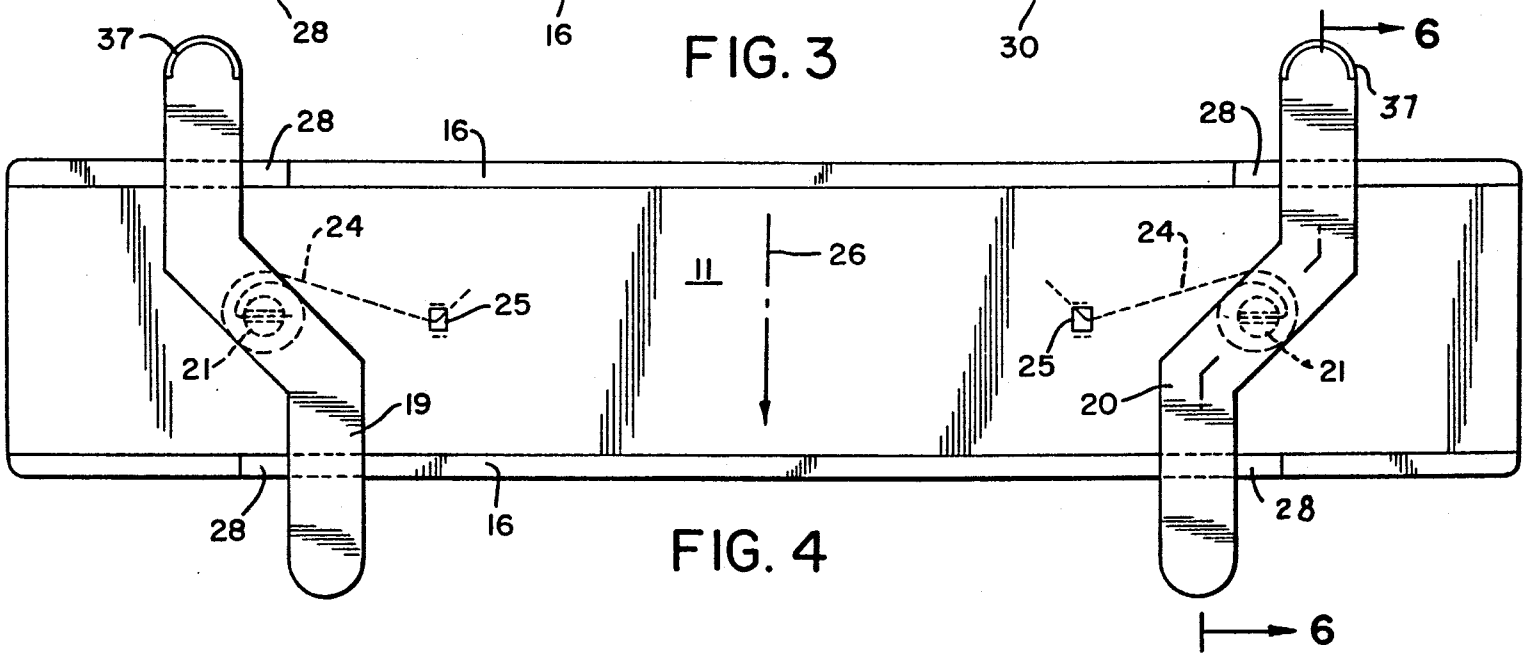
FIG. 4 is bottom view of the fan after it is removed from the packing box.

However, springs 24 constantly urge feet 19 and 20 toward their extended positions, shown in FIGS. 4 and 6, in which the end portions of the feet extend the axial direction of the fan beyond the contour of bottom wall 11. Each of the fan grills 16 presents two stops 28 which are abutted by feet 19 and 20 when the latter are in their extended positions. These stops define the extended positions of the feet, and prevent springs 24 from pivoting feet 19 and 20 beyond their extended positions.

For shipment and storage, a packing box 29 is provided. Packing box is typically formed of corrugated paperboard. Box 29 includes front wall 30, rear wall 31, end walls 32, bottom wall 33, and a top wall formed of flaps 34.

When fan 10 is packed in box 29, stabilizing feet 19 and 20 are rotated, against the force of springs 24, to their retracted positions (FIG. 3). When feet 19 and 20 are released, springs 24 tend to rotate the feet toward their extended positions. However, this rotation is prevented when the ends of feet 19 and 20 engage box walls 30 and 31. Thus, it is the box walls which retain feet 19 and 20 in their retracted positions against the force of springs 24.

To unpack fan 10, i.e., remove it from box 29, top wall flaps 34 are opened and handle 17 is grasped. By means of the handle, the fan is pulled upwardly out of the box. As soon as bottom wall leaves box 29 (FIG. 2), box walls 30 and 31 no longer restrain the pivotal movement of stabilizing feet 19 and 20. As a result, springs 24 are free to rotate those feet until they engage stops 28. In this condition, the feet are in their extended positions. Thus, it will be appreciated that simply by pulling fan 10 from box 29, feet 19 and 20 automatically assume their extended positions without the need for any further intervention on the part of the fan user. To repack fan 10 into box 29, it is merely necessary to rotate feet 19 and 20 to their retracted positions (FIG. 3) and insert the fan into the box.

Desirably, the end of each foot 19 and 20 closer to the air intake face of the fan frame is provided with a small, downwardly projecting heel 37. Heels 37 serve to slightly tilt fan 10 into the direction in which air leaves the fan, and in this way makes it more difficult for the reaction force of the air flow to tip the fan rearwardly, i.e., in the direction of the air intake face of the fan.

While the fan illustrated is provided with two stabilizing feet 19 and 20, it is possible that the stabilizing function could be accomplished by a single, wider, fan foot pivoted at the center of bottom wall 11. Furthermore, while it is believed most advantageous to pivotally secure feet 19 and 20 to the bottom wall 11 of the fan frame, other moveable means of attachment could be employed, and conceivably the feet might be mounted near the bottom of the side walls 12 of the fan frame.

The invention has been shown and described in preferred form only, and by way of example, and many variations may be made in the invention which will still be comprised within its spirit. It is understood, therefore, that the invention is not limited to any specific form or embodiment except insofar as such limitations are included in the appended claims.

We claim:

1. A fan and box in combination comprising:

a rectangular frame including a bottom wall, two side walls, and a top wall, an impeller supported within the frame, means for rotating the impeller to cause air to move through the frame in an axial direction, a first stabilizing foot secured to one of the walls of the frame, the foot being moveable between an extended position, in which it projects a distance axially beyond the contour of the wall to which it is secured, and a retracted position, in which it does not project said distance axially beyond the contour of the wall to which it is secured, a box in which the fan is received, the box maintaining the first foot in the retracted position, and first resilient means urging the first stabilizing foot toward its extended position, while the first foot is in its retracted position, for moving the first foot to its extended position when the fan is removed from the box.

2. A fan and box in combination as defined in claim 1 further comprising a second stabilizing foot secured to the fan frame, the first and second feet being spaced from each other in a direction transverse to the axial direction of the fan.

3. A fan and box in combination as defined in claim 1 including stop means against which the stabilizing foot abuts when the foot is in its extended position, the stop means preventing the first resilient means from moving the foot past its extended position.

4. A fan and box in combination as defined in claim 3, the interior dimensions of the box and the exterior dimensions of the fan being such that the fan fits within the box with the clearance between the fan and box in the axial direction less than the distance by which the first foot projects axially beyond the contour of the wall to which it is secured, in the extended position and the stabilizing foot engaging the interior surface of the box under the influence of the first resilient means thereby defining the retracted position of the foot, the resilient means automatically springing the foot to its extended position upon removal of the fan from the box.

5. A fan and box in combination as defined in claim 4 the interior dimensions of the box and the exterior dimensions of the fan being such that the fan fits within the box with the clearance between the fan and box in the axial direction less than the distance by which the first and foot projects axially beyond the contour of the wall to which it is secured, when in the extended position and wherein the first stabilizing foot is accommodated within the box when the foot is in its retracted position but not when the foot is in its extended position.

6. A fan and box in combination as defined in claim 1 wherein the stabilizing foot is pivotally secured to its respective frame wall.

7. A fan and box in combination as defined in claim 1 wherein the stabilizing foot is pivotally secured to the bottom wall of the fan frame.

8. A fan and box in combination as defined in claim 1 further comprising a second stabilizing foot pivotally secured to said one of the walls of the fan frame, the first and second feet being spaced from each other along the length of, said one wall in a direction transverse to the axial direction of the fan frame, and second resilient means urging the second stabilizing foot toward its extended position when the second foot is in its retracted position.

9. A fan and box in combination as defined in claim 8 including stop means fixed with respect to the fan frame against which the feet abut when the latter are in their extended positions.

10. A fan and box, in combination, as defined in claim 9 wherein the interior dimensions of the box and the exterior dimensions of the fan are such that the fan fits within the box with the clearance between the fan and box in the axial direction less than the distance by which each of the first and second feet projects axially beyond the contour of the wall to which they are secured, when in the extended positions and the stabilizing feet engage the interior surface of the box so that the box retains the feet in their retracted positions against the force of the resilient means, the resilient means serving to spring the feet into their extended positions upon removal of the fan from the box.

* * * * *